US005586793A

United States Patent [19]

Davenport

[11] Patent Number: 5,586,793

[45] Date of Patent: Dec. 24, 1996

[54] LOCK FOR SLIDE BOLT LATCHES

[76] Inventor: Charles L. Davenport, 34 Sherry Dr., Southington, Conn. 06489

[21] Appl. No.: 577,497

[22] Filed: Dec. 22, 1995

[51] Int. Cl.[6] ..... E05C 5/00

[52] U.S. Cl. ..... 292/67; 292/288; 292/DIG. 54; 49/367

[58] Field of Search ..... 292/288, 1, 63, 292/67, 57, DIG. 30, DIG. 54; 49/367

[56] References Cited

U.S. PATENT DOCUMENTS

| | | | |
|---|---|---|---|
| 1,015,338 | 1/1912 | Peel . | |
| 1,294,462 | 2/1919 | Herlihy . | |
| 1,723,007 | 8/1929 | Bittorf . | |
| 2,174,989 | 10/1939 | Lyons | 49/367 |
| 2,631,877 | 3/1953 | Ainsworth . | |
| 3,103,996 | 9/1963 | Wyatt, Jr. | 49/367 |
| 4,477,110 | 10/1984 | Smith | 292/1 |
| 5,174,456 | 12/1992 | Grody | 292/288 |
| 5,428,925 | 7/1995 | Snyder | 49/367 |

*Primary Examiner*—Rodney M. Lindsey
*Attorney, Agent, or Firm*—Pepe & Hazard

[57] ABSTRACT

A door latch assembly having open and closed positions comprises a door latch and a locking clip removably mounted upon it. The door latch has a bracket mounted on a door and an elongated bolt with a shank slidably and rotatably seated in the bracket. The bolt includes a shank with a handle at one end and a locking arm at the other end extending substantially perpendicularly to the shank. The bolt is rotatable at least 90° about its axis to move the arm between a first position to a second position, and is also reciprocable axially in the bracket to move the arm portion from a first position spaced from the bracket to a second position adjacent to the bracket. The locking clip is removably mounted upon the shank of the bolt between the locking arm of the bolt and the bracket in the first axial position of the bolt, so that, when the clip is mounted upon the bolt, the clip restricts the axial movement of the bolt from the first position by its abutment against the bracket.

12 Claims, 2 Drawing Sheets

LOCK FOR SLIDE BOLT LATCHES

BACKGROUND OF THE INVENTION

The present invention relates generally to latches for doors which have sliding bolts and, more particularly, to locking clips for attachment to the sliding bolt latch of hatchway doors.

Sliding bolt latches are widely employed to lock hatchway doors shut and prevent unauthorized entry into dwellings and other buildings. The sliding bolt is normally fabricated from a metal rod having an elongated shank and oppositely bent arms at either end. The shank is slidably and pivotally mounted in a bracket on the inside of one of the pair of hatchway doors and may be slid over a locking abutment on the opposite hatchway door to prevent opening the doors from the outside. To prevent the sliding bolt from being slidably disengaged from the abutment, it may be rotated so that the arm engages the locking abutment to prevent the bolt from sliding.

Unfortunately, this type of sliding bolt latch for hatchway doors is subject to outside manipulation by an intruder, who may, in attempting an unauthorized entry, forcibly vibrate or otherwise cause the bolt to rotate the arm free from the locking bracket on the opposite door and then move the bolt axially. Once the sliding bolt is disengaged from the opposite door, the doors may be easily opened.

Although locks other than sliding bolt latches are available for hatchway doors, they are often more complex, expensive and more difficult to install than sliding bolt locks which are easily welded or brazed to the door. Moreover, other locking devices can seldom be combined with existing sliding bolt latches.

It is an object of the present invention to provide a novel locking clip which removably attaches to the elongated shank of a sliding bolt latch of a hatchway door to prevent the bolt from being slid into an unlatched position.

It is also an object to provide such a locking clip which is relatively simple in construction and easy to install onto a sliding bolt latch.

Another object is to provide a locking clip which is rugged and long lived, and which may be fabricated relatively easily and economically.

SUMMARY OF THE INVENTION

It has now been found that the foregoing and related objects may be readily attained in a door latch assembly having open and closed positions which comprises a door latch and a locking clip removably mounted upon it. The door latch has a bracket adapted to be mounted on a door and an elongated bolt seated in the bracket. The bolt has a shank with a handle portion at one end thereof and a locking arm at the other end thereof extending substantially perpendicularly to the shank, and the shank is slidably and rotatably seated in the bracket. The bolt is rotatable at least 90° about its axis to move the arm between a first position and a second position and is reciprocable axially in the bracket to move the arm portion from a first position spaced from the bracket to a second position adjacent thereto.

The locking clip is removably mounted upon the shank of the bolt between the locking arm of the bolt and the bracket in the first axial position of the bolt, so that when the clip is mounted upon the bolt, the clip restricts the axial movement of the bolt from the first position by its abutment against the bracket.

Generally, the clip has channel extending along its length and is formed of a resiliently deflectable material to permit the sides about the channel to deflect to enable passage of the shank into the channel. Preferably, the channel has an enlarged base portion to seat snugly the shank, and outer portion of the channel is narrower than the diameter of the shank. Desirably, the outermost portion of the channel increases in width towards its upper end to guide the shank into the channel.

Conveniently, the handle portion of the bolt extends substantially perpendicularly to the shank, and the locking arm extends in the direction opposite the handle.

In its preferred form, the clip includes a flexible retention member having one end fastened to the clip and the other end removably fastened to the latch.

BRIEF DESCRIPTION OF THE PREFERRED EMBODIMENT

DETAILED DESCRIPTION OF THE PREFERRED EMBODIMENT

Figure 1:
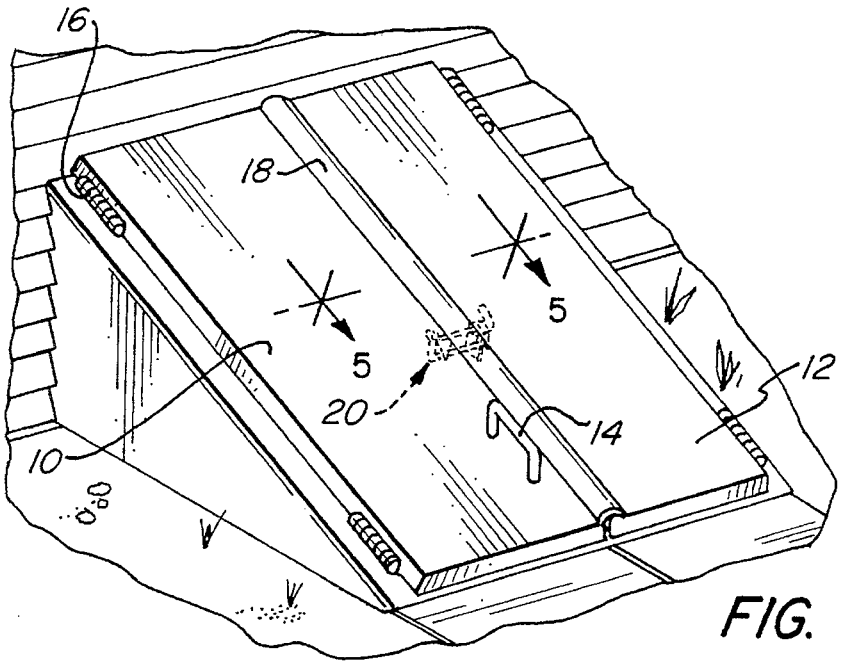
FIG. 1 is a perspective view of a hatchway double door incorporating a sliding bolt latch and a locking clip embodying the present invention, both shown in phantom line.

Turning first to FIG. 1, therein illustrated is a pair of hatchway doors 10, 12 which are pivotably mounted along their outer sides by hinges 16. The door 10 has an elongated semicircular curved portion along its inner side 18 which runs down the entire length of the center of the hatchway and overlaps the inner side portion of the door 12. A latch assembly embodying the present invention is generally designated by the numeral 20, and is mounted upon the inner surface of the door 10 adjacent the inner side 18. When unlatched, the door 10 may be readily opened from the outside by pulling upon the handle 14 attached to door 10, or pushed open from the inside.

Figure 5:
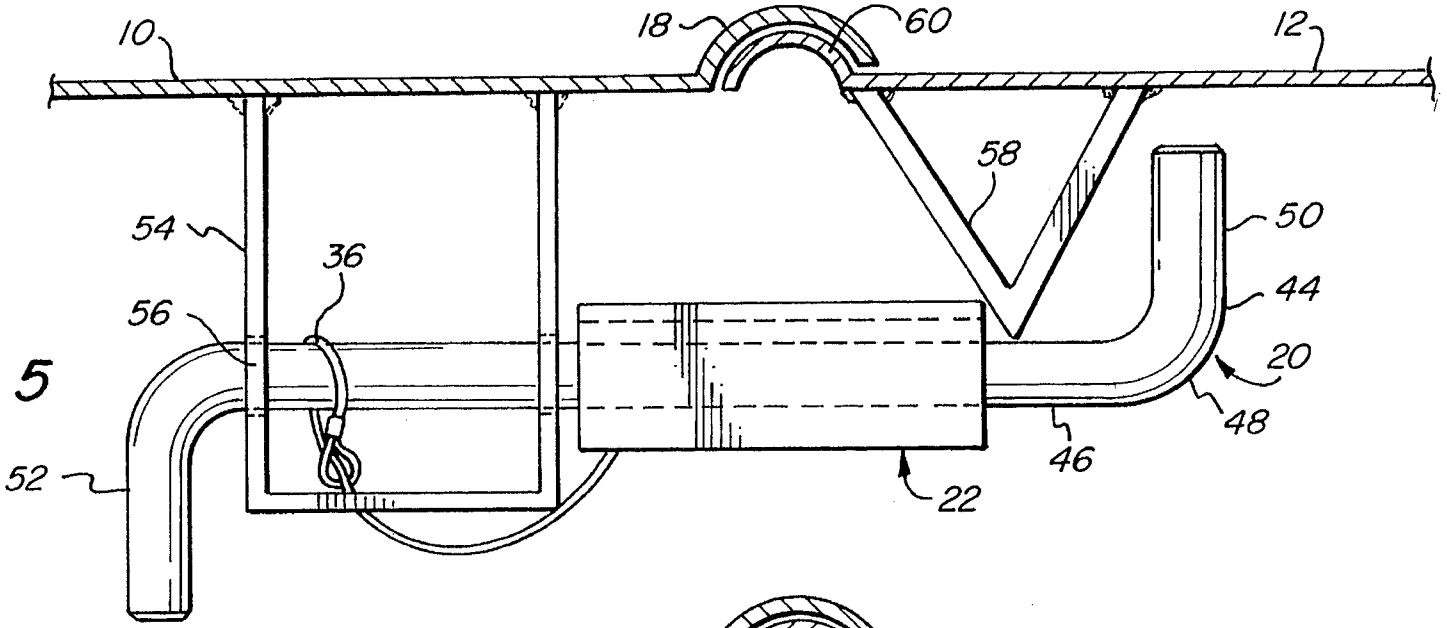
FIG. 5 is a sectional view along the line 5—5 of FIG. 1, showing the locking clip assembled onto the sliding bolt latch and drawn to a greatly enlarged scale, and with the sliding bolt latch in locked engagement with the opposite door.
Figure 6:
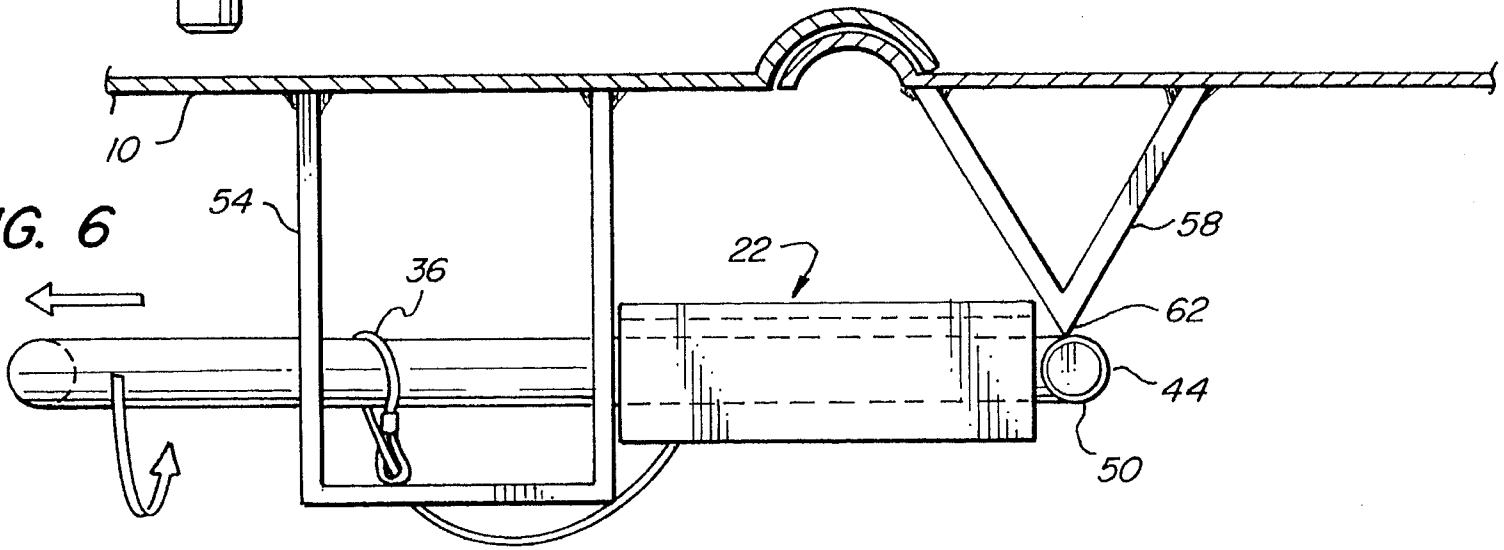
FIG. 6 is a view similar to FIG. 5 with the bolt rotated and with arrows showing the rotational and sliding movement of the bolt.

As best seen in FIGS. 5 and 6, the latch assembly 20 includes a U-shaped metal bracket 54 upon which is mounted an elongated S-shaped sliding bolt generally designated by the numeral 44, and a V-shaped keeper bracket 58 is provided on the inner surface of the door 12. Both brackets 56, 58 are formed from sheet metal and welded onto the doors 10, 12 respectively which are also fabricated from sheet metal.

The sliding bolt 44 is made of a metal rod whose end portions 50, 52 are bent perpendicularly in opposite directions to form both a locking arm 50 and a manipulating handle 52. A straight, elongated shank 46 extends between the end portions 50, 52 of the bolt 44. The shank 46 adjacent the handle 52 is slidably and rotatably seated in aligned apertures 58 of the bracket 54.

Figure 2:
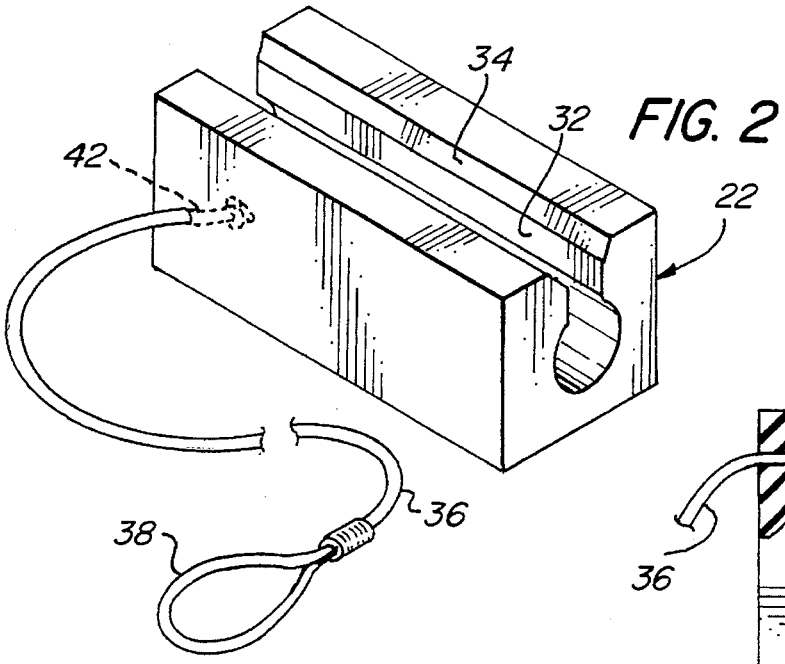
FIG. 2 is a perspective view of the locking clip of FIG. 1.
Figure 3:
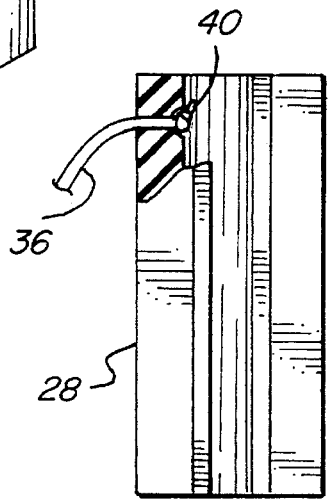
FIG. 3 is a top plan view of the locking clip with a portion broken away.
Figure 4:
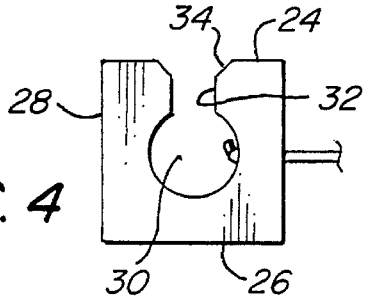
FIG. 4 is an end elevational view of the locking clip.

As best seen in FIGS. 2–4, the locking clip 22 is an elongated rectangular block with a top 24, sides 28 and bottom 26. Extending over the length of the clip 22 is a channel opening at its top 24 and having a generally circular base portion 30, a portion 32 of reduced width thereabove, and a top portion 34 with outwardly diverging surfaces 34.

As illustrated in FIGS. 5–6, the locking clip 22 is removably mounted upon the shank 46 between the brackets 54, 58. The clip 22 seats the shank 46 in its circular portion 30 when it is mounted upon the sliding bolt 44, and the circular portion 30 is preferably a slightly smaller in diameter than the shank 46 to engage the shank 46 snugly and frictionally resist being slid along the shank 46.

The sides of the clip 22 about the channel 32 are able to flex outwardly and thereby enable the clip 22 to be pushed onto the shank 46 and thereafter close to preclude the inadvertent withdrawal of the shank 46. The tapered surfaces 34 of the clip 22 facilitate movement of the shank 46 into the channel.

The locking clip 22 includes a flexible retention cord 36 to fasten the locking clip 22 to the sliding bolt 44 so that the clip 22 will not be misplaced when it is disengaged from the sliding bolt 44 and the door 10 is unlatched. The cord 36 is threaded through a small hole 42 in one side of the clip 22, and the end 40 of the cord 36 is knotted to retain the cord 36 within the hole 42. The other end portion of the cord 36 forms an expandable loop 38 which may be made large enough to pass the clip 22 therethrough for engagement and disengagement from the bolt 44.

The operation of the latch assembly 22 is illustrated in FIGS. 5 and 6. In FIG. 5 the latch assembly is fully engaged. The sliding bolt 44 extends across the center line of the hatchway and under the door 12. The locking arm portion 50 of the sliding bolt 48 is disposed beyond the apex 62 of the bracket 58 and extends upwardly along its far side.

Without the clip 22 in place, the sliding bolt 44 could be vibrated from outside the doors 10, 12 and thereby rotated so that the locking arm 50 is moved more than 90° from the latched position. Further forced vibration by an intruder may then result in sliding the sliding bolt 44 towards the bracket 54 mounted on the door 10 (as indicated by the arrows in FIG. 6) until it passes beyond the inner side 60 of door 12.

In contrast, when the locking clip 22 is mounted upon the shank 46 of the sliding bolt 44, it abuts the bracket 54 and stops the sliding bolt 44 from being moved towards the door 10 past the apex 62 of the bracket 58 on the door 12 as shown in FIG. 6 to prevent unwanted, outside manipulation of the latch 20 by an intruder.

The latch 20 is released by removing the clip 22 and using the handle 52 to rotate the locking arm 50 through at least 90° and then sliding the sliding bolt 44 towards the bracket 54 (as indicted by the arrows in FIG. 6) until it passes beyond the outer edge 60 of the door 12 (not shown). At this point, the door 10 can be pivoted open.

If the diameter of the base 30 of the channel in the clip 22 is less than the diameter of the shank 46 of the sliding bolt 44, the friction between the clip 22 and the shank 46 will usually be enough to withstand the axial forces acting on the clip 22 when the bolt 44 is slid towards the door 10. The clip 22 will then stop the sliding motion of the bolt 44 when it abuts the bracket 54. However, if the axial sliding force is greater than the frictional force between the clip 22 and the shank 46, the clip 22 will stop the sliding motion of the sliding bolt 44 towards the door 10 by abutting both the bracket 54 and the locking arm 50 at either end of the clip 22 and resisting the compressive force acting therebetween.

Thus, the locking clip 22 prevents unwanted, outside manipulation of the latch 20 by an intruder.

As will be appreciated, various materials may be employed for the fabrication of the clip 22. Most conveniently, the clip is extruded or molded from a flexible elastomer such as natural rubber or isoprenes. This enables it to snap into assembly onto the sliding bolt while better gripping the bolt to resist being slid therealong. Moreover, since the length of the sliding bolts of hatchway door latches vary in length, the flexible material may be easily cut to reduce the length of the clip to allow it to fit a variety of door latches.

Thus, it can be seen from the foregoing detailed description and accompanying drawings that the novel latch assembly of the present invention is one which foils unwanted outside manipulation of the sliding bolt latch by an intruder and yet it may be quickly and easily installed by a homeowner and is easy enough to be removed from the inside of the hatchway door by a child. Moreover, the clip may be readily and economically fabricated for a large variety of sliding bolt door latches.

Having thus described the invention, what is claimed is:

1. A door latch assembly having open and closed positions comprising:

(a) a door latch having (i) a bracket adapted to be mounted on a door; and (ii) an elongated bolt having a shank with a handle portion at one end thereof and a locking arm at the other end thereof extending substantially perpendicularly to said shank, said shank adjacent said one end being slidably and rotatably seated in said bracket, said bolt being rotatable at least 90° about its axis to move said arm between a first position to a second position and said bolt being reciprocable axially in said bracket to move said arm portion from a first axial position spaced from said bracket to a second axial position adjacent thereto; and, (b) a locking clip removably mounted upon said shank of said bolt between said locking arm of said bolt and said bracket in said first axial position of said bolt, whereby, when said clip is mounted upon said bolt, said clip restricts the axial movement of said bolt from said first axial position by its abutment against said bracket.

2. The door latch assembly according to claim 1 wherein said clip includes a channel extending along the length thereof between sides thereof, said clip being formed of a resiliently deflectable material to permit the sides thereof about said channel to deflect to enable passage of said shank thereinto.

3. The door latch assembly according to claim 2 wherein said channel has an enlarged base portion to seat said shank, an outer portion of said channel being of lesser width than the diameter of said shank.

4. The door latch assembly according to claim 3 wherein an outermost portion of said channel increases in width towards its upper end to guide said shank into said channel.

5. The door latch assembly according to claim 1 wherein said handle portion of said bolt extends substantially perpendicularly to said shank, and said locking arm extends in the direction opposite said handle portion.

6. The door latch assembly according to claim 1 wherein said clip includes a flexible retention member having one end fastened to said clip and its other end removably fastened to said latch.

7. A door assembly including;

(a) a pair of doors each having pivot means along one side thereof, said doors having overlying portions along the other side thereof;

(b) a locking element on the inner surface of one of said doors adjacent its overlying portion;

(c) a latch assembly mounted on the inner surface of the other of said doors adjacent its overlying portion, said latch assembly having a door latch having a bracket mounted on said door and an elongated bolt having a shank with a handle portion at one end thereof and a locking arm at the other end thereof extending substantially perpendicularly to said shank, said shank adjacent said one end being slidably and rotatably seated in said bracket, said bolt being rotatable at least 90° about its axis to move said arm between a first position extending along and abutting said locking element to a second position disengaged therefrom, said bolt also being reciprocable axially in said bracket to move said arm portion from a first axial position adjacent said locking element to a second axial position spaced therefrom and adjacent said bracket; and (d) a locking clip removably mounted upon said shank of said bolt between said locking arm of said bolt and said bracket in said first axial position of said bolt, whereby, when said clip is mounted upon said bolt, said clip restricts the axial movement of said bolt from said first axial position by its abutment against said bracket.

8. A door assembly according to claim 7 wherein said clip includes a channel extending along the length thereof between sides thereof and said clip is formed of a resiliently deflectable material to permit the sides thereof about said channel to deflect to enable passage of said shank thereinto.

9. The door assembly according to claim 8 wherein said channel has an enlarged base portion to seat said shank, an outer portion of said channel being of lesser width than the diameter of said shank.

10. The door assembly according to claim 8 wherein an outermost portion of said channel increases in width towards its upper end to guide said shank into said channel.

11. The door assembly according to claim 7 wherein said handle portion of said bolt extends substantially perpendicularly to said shank, and said locking arm extends in the direction opposite said handle portion.

12. The door assembly according to claim 7 wherein said clip includes a flexible retention member having one end fastened to said clip and its other end removably fastened to said latch.

* * * * *